US006106363A

United States Patent [19]

Werner

[11] Patent Number: 6,106,363

[45] Date of Patent: Aug. 22, 2000

[54] BRASSIERE WITH HELICAL UNDERWIRE

[76] Inventor: Lisa M. Werner, P.O. Box 82, Williston, Vt. 05495

[21] Appl. No.: 09/140,785

[22] Filed: Aug. 27, 1998

[51] Int. Cl.[7] ..... A41C 1/14

[52] U.S. Cl. ..... 450/41; 450/52

[58] Field of Search ..... 450/7, 41, 42, 450/43, 44, 45, 46, 47, 48, 49, 51, 52, 53

[56] References Cited

U.S. PATENT DOCUMENTS

| | | | |
|---|---|---|---|
| 2,509,353 | 5/1950 | Johnson . | |
| 2,613,356 | 10/1952 | Russell | 2/42 |
| 2,622,244 | 12/1952 | Alberts | 2/42 |
| 2,759,190 | 8/1956 | Herbener . | |
| 2,762,055 | 9/1956 | Bermueller . | |
| 2,799,021 | 7/1957 | LaBue . | |
| 2,830,590 | 4/1958 | Verreault . | |
| 2,880,732 | 4/1959 | Smith . | |
| 2,895,481 | 7/1959 | Spitzer | 128/476 |
| 2,900,981 | 8/1959 | Herbener . | |
| 2,965,103 | 12/1960 | Blair . | |
| 3,035,584 | 5/1962 | Menkel | 128/476 |
| 3,114,374 | 12/1963 | Chalfin et al. | 128/465 |
| 3,140,494 | 7/1964 | Magidson . | |
| 3,209,756 | 10/1965 | Rowell | 128/476 |
| 3,378,012 | 4/1968 | Schwartz | 128/476 |
| 3,562,802 | 2/1971 | Avis | 128/476 |
| 3,599,643 | 8/1971 | Schwartz | 128/465 |
| 3,605,753 | 9/1971 | Schwartz | 128/476 |
| 3,702,614 | 11/1972 | Miller | 128/476 |
| 3,722,513 | 3/1973 | Ertszek | 128/465 |
| 3,777,763 | 12/1973 | Schwartz | 128/476 |
| 3,799,175 | 3/1974 | Rowell | 128/476 |
| 4,133,316 | 1/1979 | Schwartz | 450/52 |
| 4,235,240 | 11/1980 | Cousins | 128/476 |
| 4,558,705 | 12/1985 | O'Boyle et al. | 450/52 |
| 4,646,746 | 3/1987 | O'Boyle et al. | 450/52 |
| 5,141,470 | 8/1992 | Morgan et al. | 450/52 |
| 5,387,150 | 2/1995 | Terrell | 450/41 |
| 5,472,366 | 12/1995 | Moore | 450/41 |
| 5,527,202 | 6/1996 | Morgan et al. | 450/48 |
| 5,730,641 | 3/1998 | Brown | 450/41 |

OTHER PUBLICATIONS

Jean–Paul Gaultier, Costume Sketch from the Blond Ambition Tour, in Adam Sexton, Ed. "Desperately Seeking Madonna" Dell Publishing, New York, 1993, p. 139.

*Primary Examiner*—Bibhu Mohanty
*Assistant Examiner*—Shirra L. Jenkins
*Attorney, Agent, or Firm*—Theodore R. Touw

[57] ABSTRACT

A flexible bra-cup support for brassieres of the underwire type is formed by a length of generally helical coil spring for flexible support and improved control of flexibility in comparison with rigid or semi-rigid supports. The helix is preferably formed from a plastic material such as nylon or polyethylene. The support is held in a conventional sleeve disposed along the undercup portions of the bra. The support may have a circular cross-section or may be made in an elliptical or other shape to control its flexibility as a function of bending direction. The helical support may have a core extending along its axis. The core may be a resilient rubber or plastic material, or an axial core wire surrounded by a resilient sheath. The pitch of the helix may be uniform, but optionally varies along the length of the support to vary the spring's rigidity with position along the undercup line. The ends of the spring may be bent back into the axial line to prevent their poking through the bra fabric and/or causing discomfort. The ends may be bent into a twist, loop, or semi-circular form for sewing in place after insertion in the sleeve part. They may be formed or bent to fit a plastic end-piece. Other bends may be made at intervals spaced along the support length to provide salient portions for fastening the spring to the bra fabric, e.g. by sewing.

8 Claims, 3 Drawing Sheets

BRASSIERE WITH HELICAL UNDERWIRE

FIELD OF THE INVENTION

This invention relates generally to supports used in brassieres and, more particularly, to brassieres having underwire supports formed with a generally helical form.

BACKGROUND OF THE INVENTION

The use of generally U-shaped "underwire" elements for shaping and supporting the lower periphery of bra cups has long been known in the art. The terminology "underwires" has been in common use to refer to such elements, more recently without any implication that the underwire element is formed of metal wire material, and such elements have been made of many different materials. Commonly, such underwire support elements have been inserted into fabric sleeves disposed about the lower periphery of the bra cups.

DESCRIPTION OF THE RELATED ART

Modem underwires are generally formed of relatively thin lengths of metal or polymeric material having a rectangular or rounded cross-section. A fairly stiff length of such material is shaped into a generalized U-shape held within a U-shaped sleeve disposed about the periphery of the under side of each bra cup. These stiff metal underwires are often coated with various polymeric materials and often have plastic tips disposed at each end of the underwire. Underwires are described in U.S. Pat. Nos. 3,378,012, 3,599,643, 3,605,753, 3,777,763, and 4,133,316 to Schwartz, for example. Various improvements in the materials and shapes of underwire support elements have been described in U.S. Pat. No. 3,035,584 to Menkel, U.S. Pat. No. 3,114,374 to Chalfin et al., U.S. Pat. Nos. 3,209,756 and 3,799,175 to Rowell, U.S. Pat. No. 3,702,614 to Miller, U.S. Pat. No. 4,235,240 to Cousins, U.S. Pat. Nos. 4,558,705 to O'Boyle et al., 4,646,746 to O'Boyle, U.S. Pat. No. 5,141,470 to Morgan et al., U.S. Pat. No. 5,472,366 to Moore, and U.S. Pat. No. 5,730,641 to Brown.

While these underwire structures of the background art have achieved widespread usage, certain disadvantages result from their use. These disadvantages relate to the relative stiffness, and therefore discomfort, of conventional underwires, to the uniformity of that stiffness, and to the lack of adaptability to the needs of various users.

NOTATIONS AND NOMENCLATURE

The terms "brassiere" and "bra" as used throughout this specification and the appended claims refer to any article of apparel which utilizes bust-supporting structures (including those with vertically oriented supports, such as stays or boning). Thus these terms are meant to include swimwear, athletic apparel and gowns with integral bust-support structures, mastectomy prosthetic devices, bodices, lingerie, corsets, etc., as well as brassiere-like undergarments.

PROBLEMS SOLVED BY THE INVENTION

While the background art provides underwire support structures of varying description, the art has yet to provide an underwire structure capable of providing shape and support while being sufficiently comfortable to the wearer of the bra. Although the conventional underwire structures could be changed in shape by bending, they have generally had constant stiffness. Even those whose stiffness varied along their lengths due to non-uniform thickness have had stiffness that could not be varied after manufacture to fit the needs of various users. Furthermore, although various types of tips have been formed on conventional underwires for preventing user discomfort and for preventing poking of the underwire ends through the bra fabric, the relative stiffness of conventional underwires has prevented sufficient comfort of the wearer. The conventional underwires have not been able to conform to the wearer's body in any direction and still provide the added support of an underwire. The present invention is intended to provide improved wearer comfort and improved adaptability to the needs of various users.

OBJECTS AND ADVANTAGES OF THE INVENTION

An overall object of the invention is an improved underwire type of brassiere having a non-rigid underwire structure, providing improved comfort to the wearer of the bra. A related object is an underwire structure having a form suitable for providing and maintaining a natural curve at the bottom periphery of a brassiere cup. Another related object is an underwire adaptable for providing flexibility varying along its length. A further object is an underwire structure whose local flexibility is self-adjusting to suit the individual needs of each user. Another object is an underwire structure that is adaptable for attachment to the fabric of a bra, at one or both ends of the underwire, and/or at selected points intermediate between the ends. A specific object is a bra underwire having a helical form. A more specific object is a helical-form bra underwire having non-uniform flexibility imparted by variations in thickness, stiffness, cross-sectional shape of the material forming the helix, cross-sectional shape and/or transverse size of the helix itself, or any combination of two or more of these features, and adapting to conform to the wearer's body in any direction. These and other objects and advantages will be apparent from a reading of this specification and the appended claims, along with the drawings.

SUMMARY OF THE INVENTION

A flexible bra-cup support for brassieres of the underwire type is formed by a length of generally helical coil spring for flexible support and improved control of flexibility. Better control of flexibility is provided than with rigid or semi-rigid underwires. The spring may be formed from metal wire or from a plastic material such as nylon or polyethylene. The support is fitted into a conventional sleeve extending along the undercup portions of the bra. The support may have a circular cross-section or may be made in an elliptical, oval, polygonal, "dogbone," or other shape to control its flexibility as a function of bending direction. The helical support may have a core extending along its axis. The core within the helical support may be another wire, a resilient rubber or plastic material, or an axial core wire surrounded by a softer rubber, plastic, or foam sheath. The pitch of turns of the helix may be uniform. However, the pitch may be varied along the length of the support to vary the spring's rigidity with position along the undercup line, for controlling the support's flexibility for various models, shapes, and sizes of the brassiere product incorporating this support. The ends of the spring may be bent back into the axial line to prevent their poking through the bra fabric and/or causing discomfort. They may be bent into a twist, loop, or semi-circular form for sewing the ends in place after insertion in the sleeve part. They may be formed or bent to fit a plastic end-piece. Other bends may be made in the wire coil material at intervals spaced along the support length to provide for fastening the spring to the bra fabric, e.g. by sewing. Thus, the invention provides a brassiere comprising a helical underwire support contained within an undercup sleeve disposed at the lower periphery of each cup of the brassiere, and each helical underwire support is self-adapting in any direction to fit the user's body.

DETAILED DESCRIPTION OF THE PREFERRED EMBODIMENTS

Figure 1:
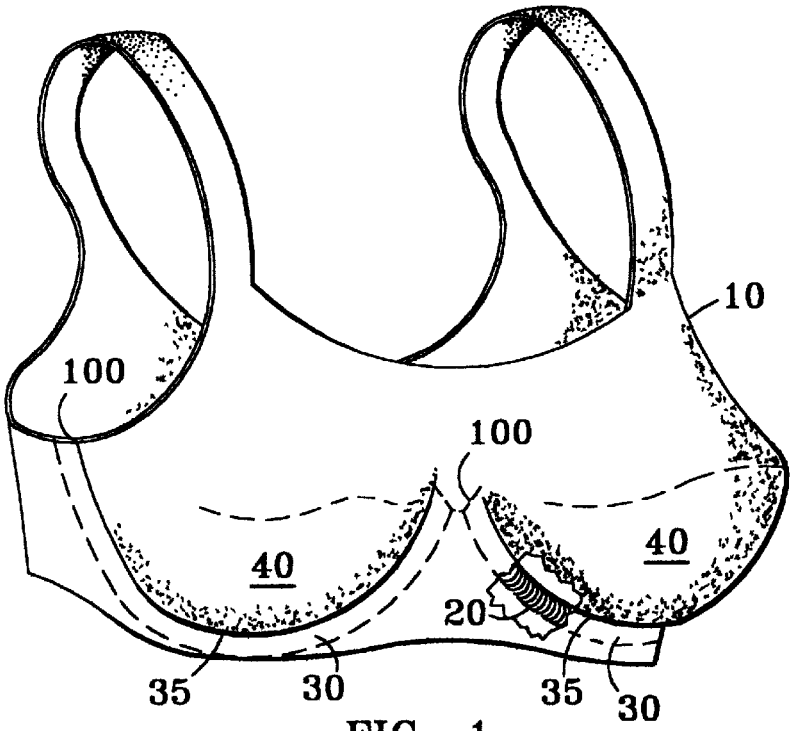
FIG. 1 shows a partially cut away perspective view of a brassiere made in accordance with the invention.
Figure 2A:
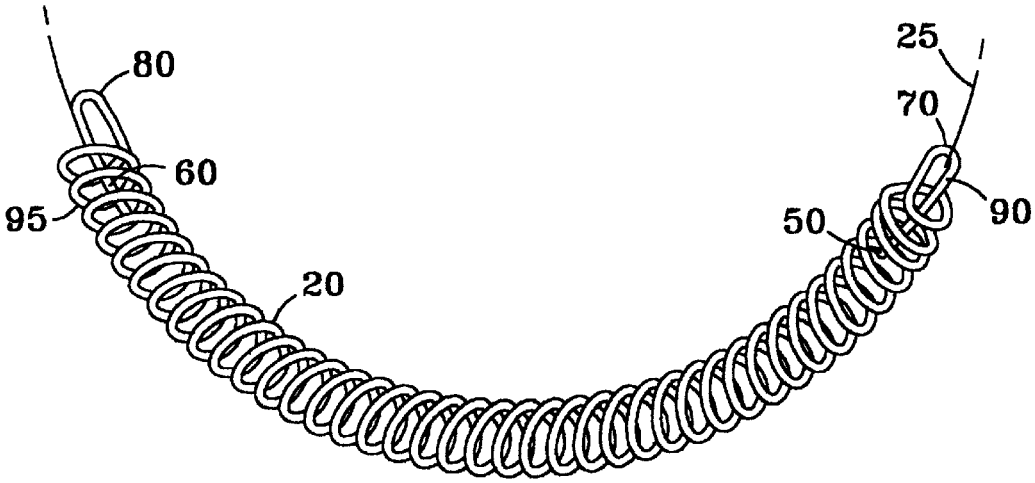
FIG. 2*a* shows a perspective view of a helical underwire for a brassiere made in accordance with the invention.

FIG. 1 shows a partially cut away perspective view of brassiere 10 made in accordance with the invention. An underwire support 20 has a helical form, shown schematically in FIG. 2. The helix form, shown in FIG. 2, is not to be confused with a spiral form which has sometimes been used in the construction of brassiere cups for support structures or merely for ornamental decoration (cf., Jean-Paul Gaultier, Costume Sketch from the Blond Ambition Tour, in Adam Sexton, Ed. "Desperately Seeking Madonna" Dell Publishing, New York, N.Y., 1993, p. 139). Such confusion of terminology could easily occur, as even some well-known dictionaries do not distinguish correctly between helices and spirals. The turns of a spiral have monotonically increasing (or decreasing) radii, while the turns of a helix have substantially constant radii, the turns advancing with distance along a longitudinal axis. Thus, if the longitudinal axis of a helix is a straight line, the turns of the helix are disposed in a cylindrical surface. Helical springs, for example, are generally very flexible, thus allowing the longitudinal axis of the helix to be bent easily into a curve. When the axis is bent into a curve, the turns of the helix define a curved cylinder like the helical bra support structure shown in FIG. 2*a*.

The longitudinal axis 25 of the helix is shown in FIG. 2*a* in the curved conformation that it normally has in use. As shown in FIG. 1, the helix has this curved conformation when disposed within a curved undercup sleeve 30 formed at the lower periphery 35 of a cup 40 of the brassiere. Of course, each brassiere normally has a pair of underwire supports, each underwire support being contained within an undercup sleeve 30 formed at the lower periphery 35 of a cup 40 of the brassiere 10. The underwire support 20 may be formed of wire, but preferably the underwire support material is a semi-rigid plastic material such as nylon or polyethylene. For simplicity, this specification refers to all such materials as "wire," without implying that the material is a metal. The wire cross-section may be circular, elliptical, oval, rectangular, triangular, dogbone, polygonal, a U-shape, or any other suitable cross-section shape, depending on the particular type of bra being manufactured and the desired variation of flexibility with bending direction. The wire cross-section for the underwire support may be selected from some alternate cross-sections shown in FIGS. 3*a*–3*f*, such as circular (FIG. 3*a*), elliptical (FIG. 3*b*), rectangular (FIG. 3*c*), triangular (FIG. 3*d*), dogbone (FIG. 3*e*), and polygonal (e.g., FIG. 3*f*) cross-sections or any other suitable cross-section shape. The cross-sectional shapes of FIGS. 3*a*–3*f* are meant to be illustrative only, and are not intended to limit the invention. The cross-sectional shape and diameter may be varied along the length of the wire, to provide flexibility varying longitudinally along the helical underwire 20. Underwire helix diameter may be, e.g., <1 mm to about 6 mm.

Figure 2B:
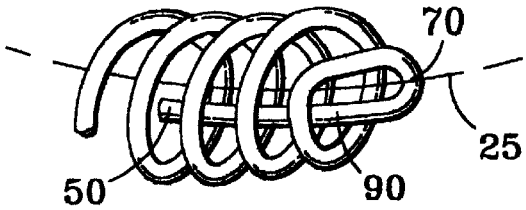
FIG. 2*b* shows a detail thereof.
Figure 3A:
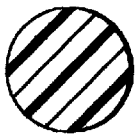
FIGS. 3*a*–3*f* show cross-sectional views of various alternative shapes of the material from which the invention is formed.
Figure 3B:
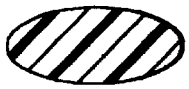
Figure 3C:
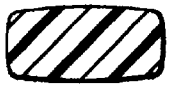
Figure 3D:
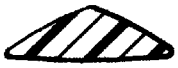
Figure 3E:
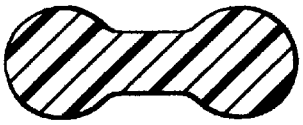
Figure 3F:
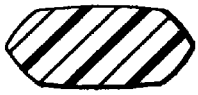

The ends 50 and 60 of the wire forming the underwire support helix may be bent around as shown in FIG. 2*b* to form at least partial loops 70 and 80, preferably extending back along the axis of the helix as shown at re-entrant portions 90 and 95. This preferred configuration of the ends prevents poking of the wire end through the bra fabric, and thus prevents wearer discomfort and prevents damage to the normally closed ends 100 of the fabric sleeve 30. The preferred end configuration shown in FIG. 2*b* also provides means for optionally attaching an end of the underwire to the bra fabric, e.g., by sewing through the fabric and the end loops 70 and/or 80.

Figure 4A:
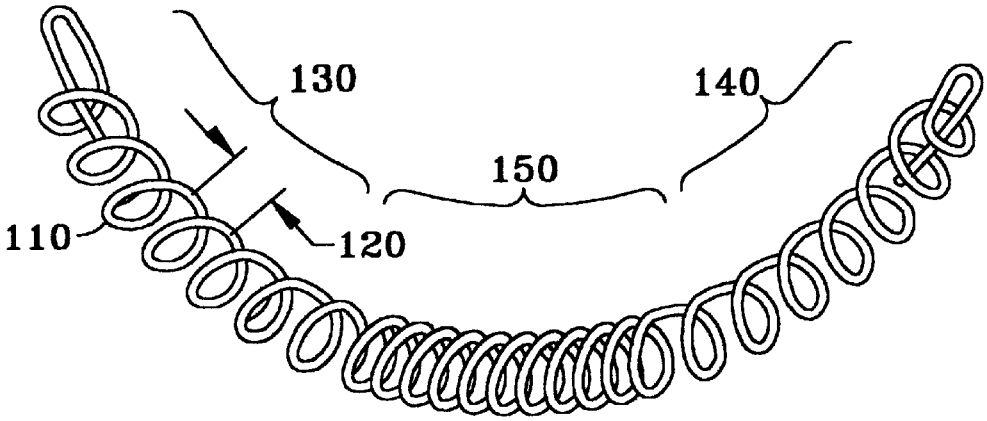
FIG. 4*a* shows a perspective view of a first preferred embodiment of a helical underwire structure.
Figure 4B:
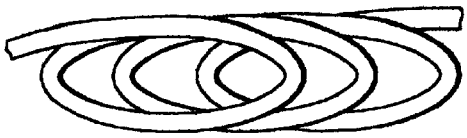
FIG. 4*b* shows a detail thereof.
Figure 5A:
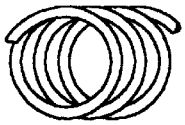
FIGS. 5*a*–5*f* show details of various alternative shapes of the helix itself in which the invention is formed.
Figure 5B:
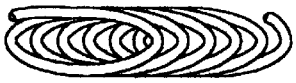
Figure 5C:
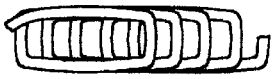
Figure 5D:
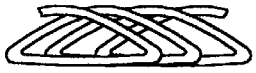
Figure 5E:
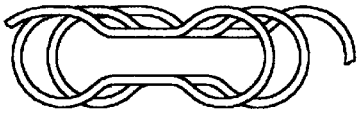
Figure 5F:
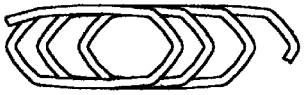

FIGS. 4*a* and 4*b* show a first preferred embodiment 110 of a helical underwire structure. In FIG. 4*a*, the pitch 120 of the turns of the helix is not uniform, but is varied with position along the axis in a preferred manner. The turns are relatively further apart (larger pitch) in regions 130 and 140 near the ends of the underwire support, while the turns are closer together (smaller pitch) in the region 150 between the end regions. Thus, all else being equal, the end regions 130 and 140 of the underwire are relatively more flexible than the "central" portion 150. (In practice, the preferred location of minimum pitch is near the lowest point of the curve of the lower periphery of the bra cup, which is not necessarily at the geometric center of the underwire.) One suitable variation of pitch is that obtained by suspending the helix from its ends. Gravity causes the helix axis to assume a curved catenary shape approximated by the equation $y=k\cosh(x/k)$, where x and y are horizontal and vertical coordinates along the helix' axis respectively, and k is a constant characteristic of the particular helix. (This equation is exact only for a helix with uniform density along its axis; if some coils of the helix stretch further apart relative to others, thus varying the density, the equation is only approximate.) It should be mentioned that a portion of the underwire helix may have the minimum pitch equal to the wire diameter, i.e., having adjacent turns contiguous, with no space between turns. Relatively, this pitch provides the least flexibility for that portion, other factors being equal. FIG. 4*b* shows a substantially elliptical cross-section of the helix of FIG. 4*a*. The long axis of the ellipse is preferably oriented tangentially to the fabric of the bra cup at its bottom periphery.

FIGS. 5*a*–5*f* show various alternative cross-sectional shapes of the helix itself in which the invention is formed. The helix cross-section of the underwire support is selected from circular (FIG. 5*a*), elliptical (FIG. 5*b*), rectangular (FIG. 5*c*), triangular (FIG. 5*d*), dogbone (FIG. 5*e*), and polygonal (e.g., FIG. 5*f*) cross-sections. These individual cross-sectional shapes may be used, not only for an entire helical underwire, but, in principle, the helix' cross-section may vary in shape along its length to provide further control of local flexibility in various directions. Such variations complicate the manufacture of the underwire, however.

Figure 6:
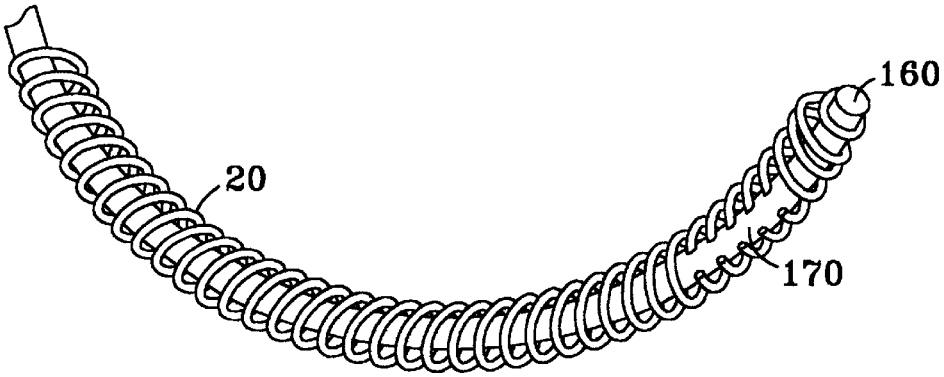
FIG. 6 shows a perspective view of a second preferred embodiment of a helical underwire structure.

FIG. 6 shows a second preferred embodiment of the invention. As shown in FIG. 6, the underwire support may also include an axial core 160 extending along at least a portion of the coil axis of the helix. Axial core 160 may be a wire formed from the same material as the helix, and may be bent back along a direction parallel to the coil axis. Axial core 160 may be piping (a tubular band of material, sometimes containing a cord, used for trimming the edges and seams of clothing) or other fabric material. However, axial core 160 is preferably made from a semi-rigid material such as a thermoplastic elastomer of suitable resiliency or a foam-rubber-like material. Axial core 160 may be formed by covering a core wire with semi-rigid material 170. Core 160 decreases deformation of the cross-section of the helix and increases underwire durability. This is especially useful for the more complex cross-sections. The cross-section of core 160 may be made to match the helix cross-sectional shape.

Figure 7:
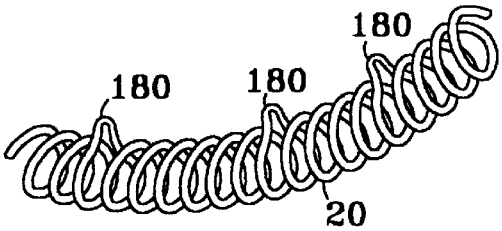
FIG. 7 shows a perspective view of a detail of an alternative embodiment of a helical underwire structure.

FIG. 7 shows a detail of an alternative embodiment of a helical underwire structure. Selected coil turns of the helix are further formed with a salient portion 180 extending radially outward for optionally attaching to the fabric of the undercup sleeve, e.g., by sewing through the fabric and through the opening of salient portion 180. Salient portion 180 may be formed into a loop or twist or any other suitable shape.

In its simplest forms, the underwire support may be made by conventional methods used for the manufacture of helical springs. The wire material is wound about a mandrel of suitable shape, and turns are removed from the mandrel after being formed. Lengths of helix are cut to a desired length, taking into account any further bending of end portions to form end loops and re-entrant portions, if used. For more complex shapes such as the dogbone shape of FIG. 5*e*, another conventional forming operation is needed to form the inward bends. Similarly, additional bending operations are used to form the salient portions 180 of FIG. 7. For underwire supports made from the preferred semi-rigid polymeric materials, lengths of helix including the end arrangements and/or salient portions, if used, may be formed by conventional plastic molding methods. Simple conventional methods may be used for inserting a core element 160 into the helix. Alternatively, the helix may be wound around a core element 160. Methods for coating a core element with a semi-rigid material 170 are well-known.

Figure 8:
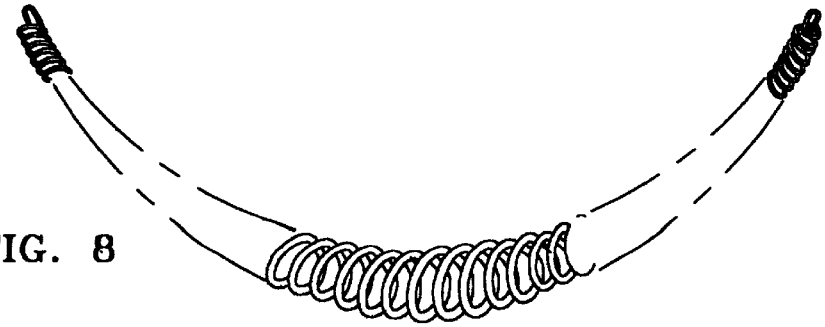
FIG. 8 shows a perspective view of a third preferred embodiment of a helical underwire structure.

FIG. 8 shows a perspective view of a third preferred embodiment of a helical underwire, in which the helix diameter varies longitudinally. The helix diameter is relatively smaller in a portion adjacent to each end of the underwire than in a portion ) if intermediate between its ends. This tapering of the helix diameter provides relatively greater flexibility near the ends and relatively more support near the "central" portion.

Thus, in its simplest embodiment, the brassiere underwire support 20 of the invention is a helix of wire-like material. If desired, the support ends are bent to form at least partial loops and re-entrant portions, the re-entrant portion extending substantially parallel to the coil axis of the helix. A brassiere 10 normally has a pair of helical underwire supports 20, each contained within an undercup sleeve 30 formed at the lower periphery 35 of a cup 40 of the brassiere. Each underwire support may include an axial core 160 extending along at least a portion of the helix' axis, and the axial core 160 may comprise a wire at least partially covered with a semi-rigid material 170. The helix pitch 120 may be varied along the length of the support, the helix pitch preferably being relatively larger in a region 130 and/or 140 adjacent to each end of the support, and the helix pitch being relatively smaller in a region 150 of the underwire intermediate between the end regions 130 and 140. The brassiere cup 40 normally has an undercup sleeve formed of fabric, and selected coils of the helix may be formed with a salient portion 180 extending radially outward for optionally attaching to the fabric of the undercup sleeve.

In use, the helical underwire support is inserted into the sleeve and optionally fastened in place, by sewing the ends of the sleeve closed and/or by sewing through loops of the helix or through salient portions formed on selected loops. The fastening positions may be selected to arrange the desired variation of pitch of the helix (stretching the helix to predetermined attachment points to increase the pitch in the region stretched). Such methods of fastening allow a degree of customization of the relative stiffness at various portions of the underwire.

Thus, the invention provides a brassiere comprising a helical underwire support contained within an undercup sleeve disposed at the lower periphery of each cup of the brassiere, and each helical underwire support is self-adapting in any direction to fit the user's body.

From the foregoing description, one skilled in the art can easily ascertain the essential characteristics of this invention, and without departing from the spirit and scope thereof, can make various changes and modifications of the invention to adapt it to various usages and conditions. For example, the helix' cross-section may be simultaneously varied in both shape and thickness along its length to provide further control of local flexibility in various directions. The principles of the invention may be applied to the boning of wedding gowns and other such articles of clothing. Such alterations and modifications may differ particularly from those that have been described in the preceding specification and description. It should be understood the appended claims are intended to encompass all such modifications. Accordingly, the scope of the invention should be determined not by the embodiments illustrated, but by the appended claims and their legal equivalents.

Having described my invention, I claim:

1. An underwire support for a brassiere, said support having a helical form, wherein said support has two support ends, at least one of said support ends being bent to form at least a partial loop, and wherein said helical form has a coil axis, said at least one of said support ends being further bent to form a re-entrant portion extending substantially parallel to said coil axis of said helical form.

2. An underwire support for a brassiere, said support having a helical form, wherein selected coils of said helical form include a salient portion extending radially outward for attaching to fabric.

3. An underwire support for a brassiere, said support having a helical form, a coil axis, and two support ends, wherein at least one of said support ends is bent to form at least a partial loop and a re-entrant portion, said re-entrant portion extending within said helical form and substantially parallel to said coil axis of said helical form.

4. A brassiere, comprising a pair of underwire supports, each underwire support as recited in claim 3.

5. A brassiere, comprising an underwire support contained within an undercup sleeve disposed at the lower periphery of each cup of said brassiere, each said underwire support having a helical form, wherein said undercup sleeve is formed of fabric, and wherein selected coils of said helical form are further formed with a salient portion extending radially outward for attaching to said fabric of said undercup sleeve.

6. A brassiere as in claim 5, wherein each of said salient portions is optionally attached to said fabric of said undercup sleeve.

7. An underwire support for a brassiere, said support having a helical form and said helical form having a coil axis, wherein said coil axis has a catenary shape described by the equation $$y=k \cosh (x/k),$$

where x and y respectively are horizontal and vertical coordinates along said coil axis and k is a constant.

8. A brassiere, comprising a pair of underwire supports as recited in claim 7, each underwire support having a coil axis and each coil axis having said catenary shape, each underwire support being contained within an undercup sleeve disposed at the lower periphery of each cup of said brassiere.

* * * * *